US006935498B1

(12) United States Patent
Ho

(10) Patent No.: US 6,935,498 B1
(45) Date of Patent: Aug. 30, 2005

(54) BAG FOR CARRYING A PORTABLE COMPUTER

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 0 days.

(21) Appl. No.: 10/850,016

(22) Filed: May 20, 2004

(51) Int. Cl.[7] ..... B65D 85/00; B65D 81/02; A45C 13/00

(52) U.S. Cl. ..... 206/320; 206/592; 190/115

(58) Field of Search ..... 206/305, 320, 206/576, 591, 592, 594; 150/110; 190/115, 190/117

(56) References Cited

U.S. PATENT DOCUMENTS 2,318,563 A * 5/1943 Smith ..... 150/107
2,555,820 A * 6/1951 Satz ..... 190/125
4,239,074 A * 12/1980 Kahn ..... 190/115
4,825,506 A * 5/1989 Weltz ..... 16/405
5,494,157 A * 2/1996 Golenz et al. ..... 206/320
6,109,443 A * 8/2000 Dercole ..... 206/581
6,338,180 B1 * 1/2002 Massard ..... 16/114.1
6,409,066 B1 * 6/2002 Schneider et al. ..... 224/585

* cited by examiner

*Primary Examiner*—Mickey Yu
*Assistant Examiner*—Faye Francis
(74) *Attorney, Agent, or Firm*—Ladas & Parry LLP

(57) ABSTRACT

A bag includes two shells to define a compartment for accommodating a portable computer, and two handles. Each handle includes a gripping segment, two upper superimposing segments which extend from two ends of the gripping segment and which are superimposed upon an upper wall portion of each shell, and two bent segments which extend respectively from the upper superimposing segments to be bent over an upper edge of the shell and which terminate at two underlying regions that are disposed underneath the upper wall portion. Joining members are disposed to firmly connect the upper superimposing segments, the upper wall portions, and the underlying regions together.

6 Claims, 6 Drawing Sheets

BAG FOR CARRYING A PORTABLE COMPUTER

BACKGROUND OF THE INVENTION

1. Field of the Invention

This invention relates to a bag for carrying a portable computer, more particularly to a bag having two handles which are firmly connected to shells of the bag so as to enable the bag to carry a relatively heavy load.

2. Description of the Related Art

Referring to FIGS. 1 to 3, a conventional portable computer bag 1 is shown to include a base pad 13, two shells 11,12 which are made from polypropylene material and which have lower side edges connected to the base pad 13 to define a compartment 17, two handles 14,15 which are respectively secured to upper portions of the shells 11,12, and a zipper unit 16 which is disposed on peripheral edges of the shells 11,12 for closing the compartment 17. The shells 11,12 have outer wall surfaces 111, 121 and inner wall surfaces 112,122. A computer compartment 18 is disposed on the inner wall surface 122 for accommodating a portable computer 2.

Each of the handles 14,15 includes a gripping segment 142,152, and two superimposing segments 141,151 which extend respectively from two ends of the gripping segment 142,152 and which are superimposed upon the outer wall surface 111,121 of an upper edge portion of the respective shell 11,12. Moreover, each zipper tape 161 of the zipper unit 16 is superimposed upon the superimposing segments 141,151 of the respective handle 14,15. A fabric 3 is disposed to cover the superimposing segments 141,151, the zipper tape 161 and the inner wall surface 122 of the upper edge portion to be stitched together so as to secure the handle 14,15 to the corresponding shell 11,12. Since each handle 14,15 has a portion (i.e. the superimposing segment 141,151) secured to the shell 11,12, its connection with the shell 11,12 is weak and it is liable to disengage from the shell 11,12.

SUMMARY OF THE INVENTION

The object of the present invention is to provide a bag which has two handles secured firmly to shells of the bag so as to render the bag more durable and to enable the bag to carry a relatively heavy load.

According to this invention, the bag includes a base wall, front and rear shells, front and rear handles, and front and rear joining members.

The base wall is elongated in a longitudinal direction, and has front and rear sides opposite to each other in a transverse direction relative to the longitudinal direction.

The front and rear shells are spaced apart from each other in the transverse direction. Each of the front and rear shells includes a lower wall portion which extends in the transverse direction and which is connected to a respective one of the front and rear sides of the base wall, a major wall portion which extends from the lower wall portion in an upright direction, and an upper wall portion which extends from the major wall portion in the transverse direction to terminate at an upper edge. Each of the front and rear shells has an inner wall surface and an outer wall surface opposite to each other. The inner wall surfaces of the front and rear shells cooperatively define a compartment for accommodating a portable computer.

The front and rear handles are made from a material more flexible than that of the front and rear shells. Each of the front and rear handles includes a gripping segment, first and second upper superimposing segments which extend respectively from two ends of the gripping segment and which are superimposed upon the upper wall portion of a corresponding one of the front and rear shells, and first and second bent segments which extend respectively from the first and second upper superimposing segments to be bent over the upper edge of the corresponding one of the front and rear shells. The first and second bent segments are disposed underneath the inner wall surface of the upper wall portion of the corresponding one of the front and rear shells, and terminate at first and second underlying regions, respectively.

Each front joining member is disposed to interconnect a respective one of the first and second upper superimposing segments of the front handle, the upper wall portion of the front shell, and a respective one of the first and second underlying regions of the front handle so as to permit the upper wall portion of the front shell to be firmly sandwiched between the first upper superimposing segment and the first underlying region of the front handle, and between the second upper superimposing segment and the second underlying region of the front handle. Each rear joining member is disposed to interconnect a respective one of the first and second upper superimposing segments of the rear handle, the upper wall portion of the rear shell, and a respective one of the first and second underlying regions of the rear handle so as to permit the upper wall portion of the rear shell to be firmly sandwiched between the first upper superimposing segment and the first underlying region of the rear handle, and between the second upper superimposing segment and the second underlying region of the rear handle.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
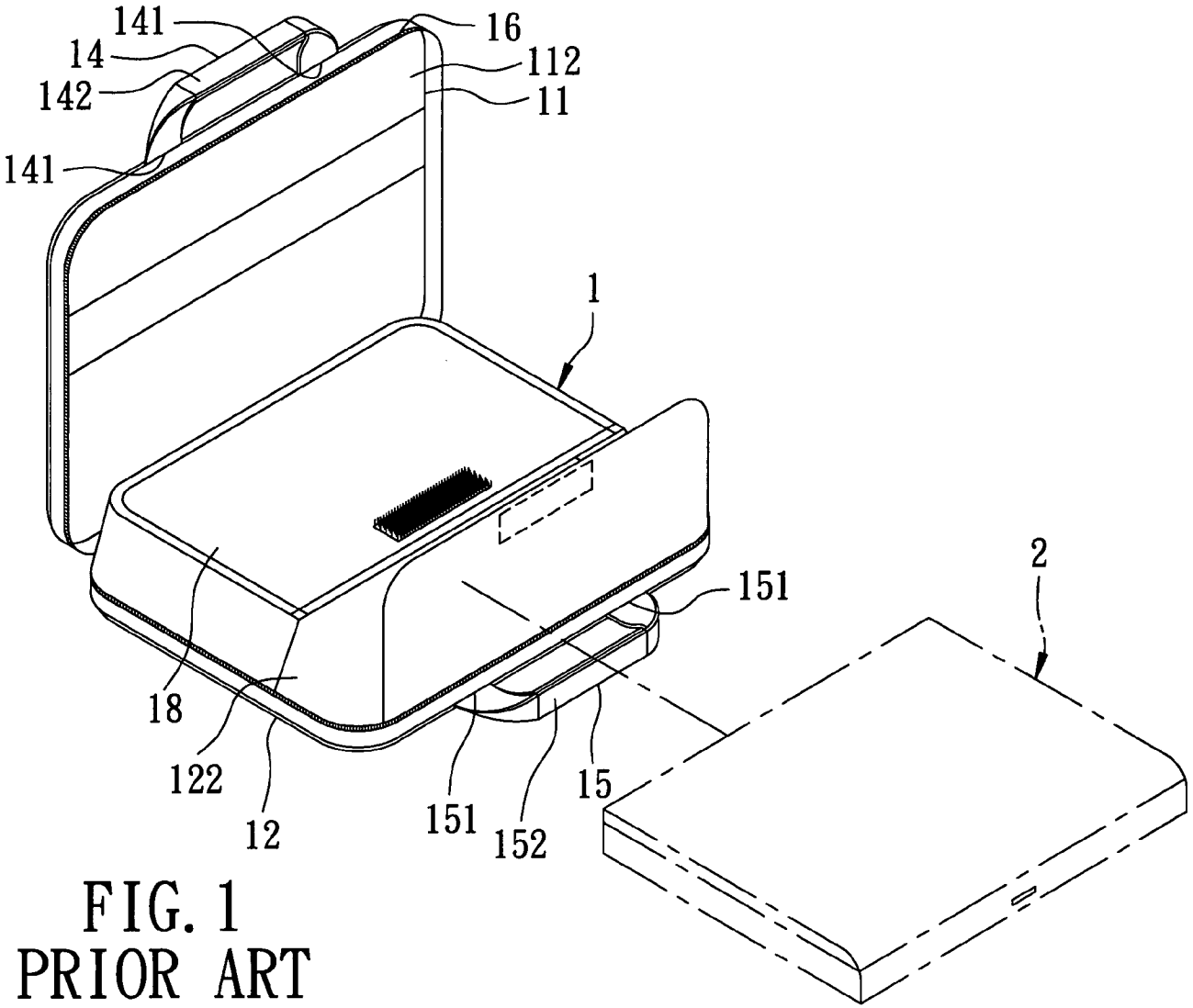
FIG. 1 PRIOR ART
FIG. 1 is a perspective view of a conventional portable computer bag in a closed state.
Figure 2:
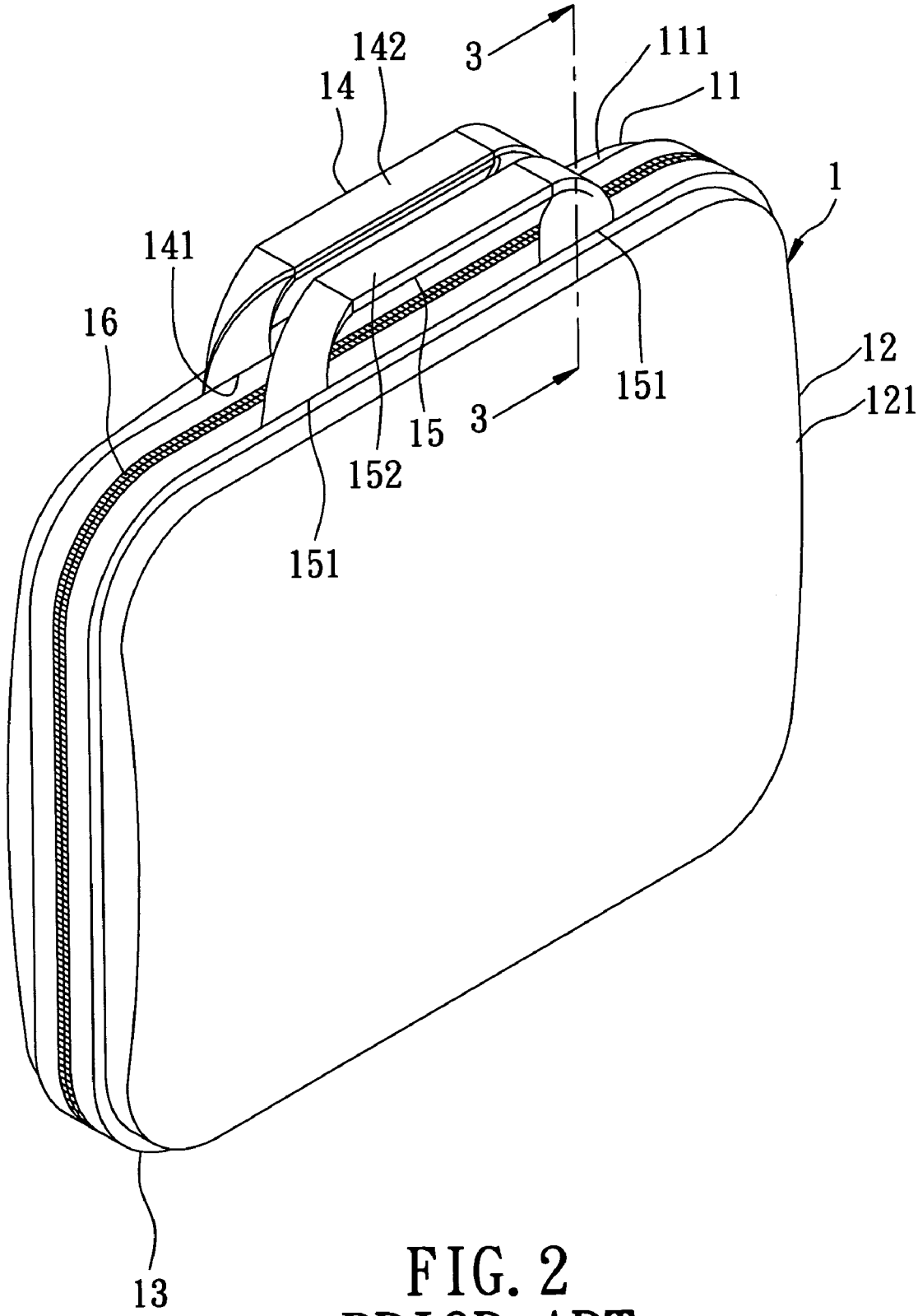
FIG. 2 PRIOR ART
FIG. 2 is a perspective view of the conventional portable computer bag in an open state.
Figure 3:
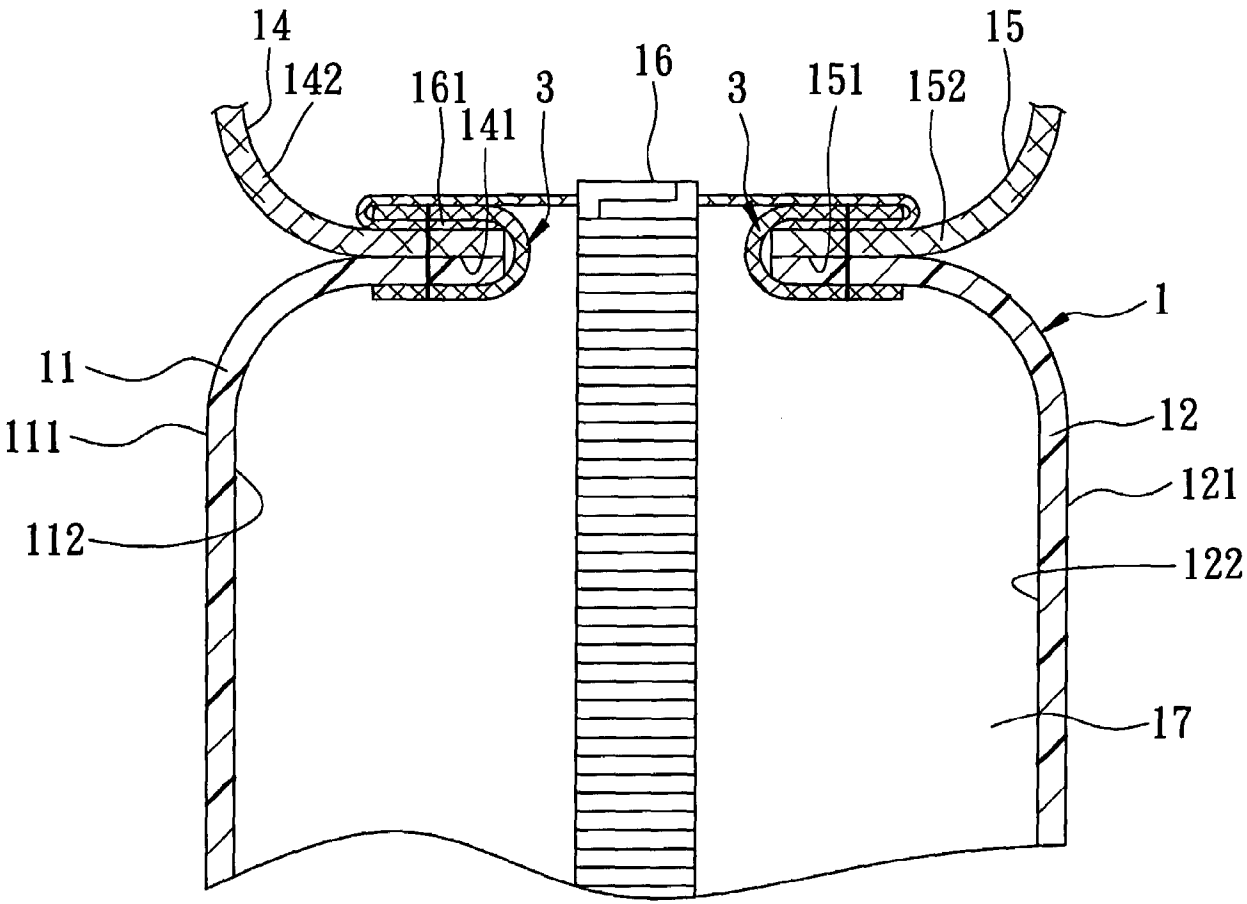
FIG. 3 PRIOR ART
FIG. 3 is a fragmentary sectional view of the conventional portable computer bag, taken along a line 3—3 in FIG. 2.
Figure 4:
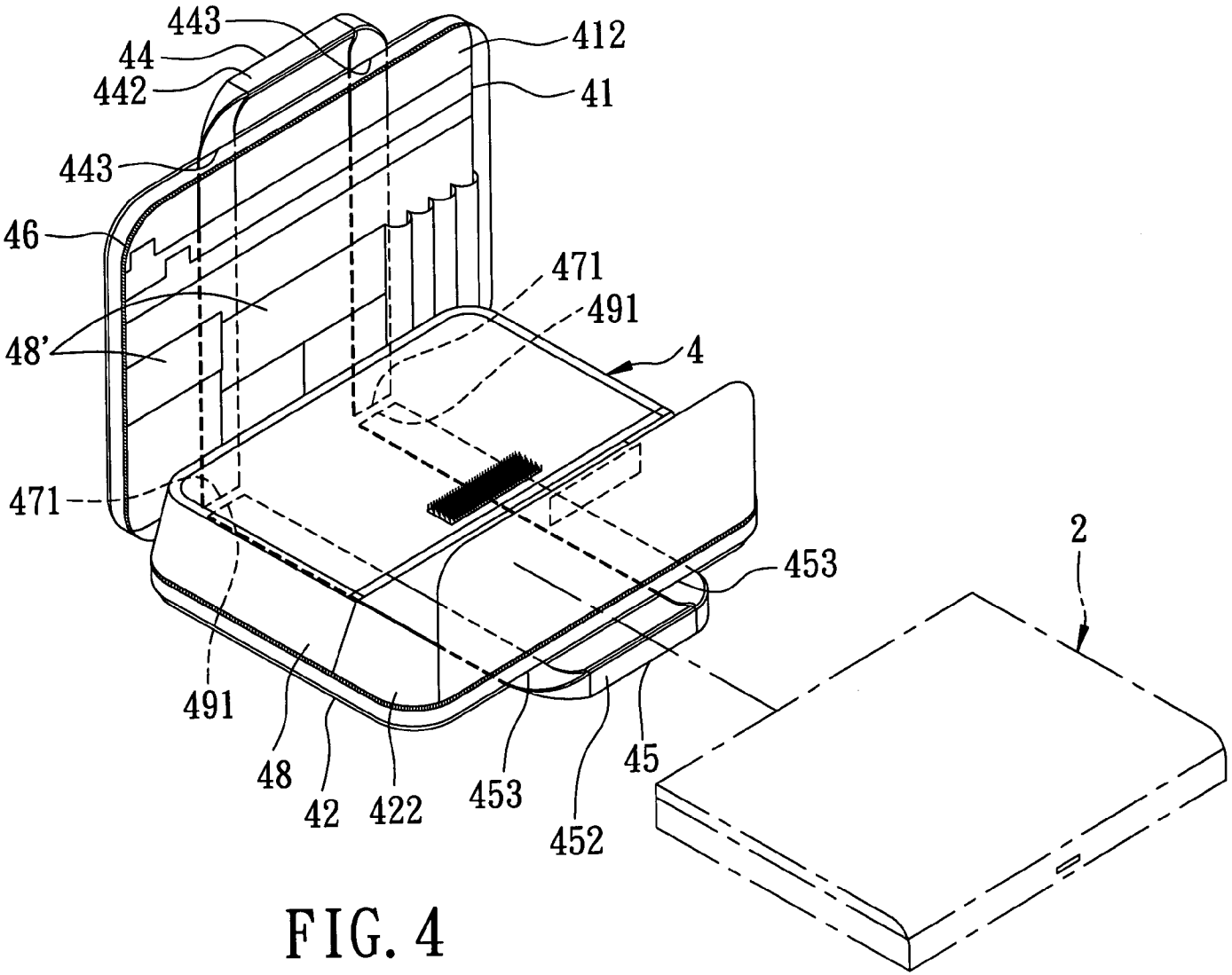
FIG. 4 is a perspective view of a preferred embodiment of a bag according to this invention in an open state.
Figure 5:
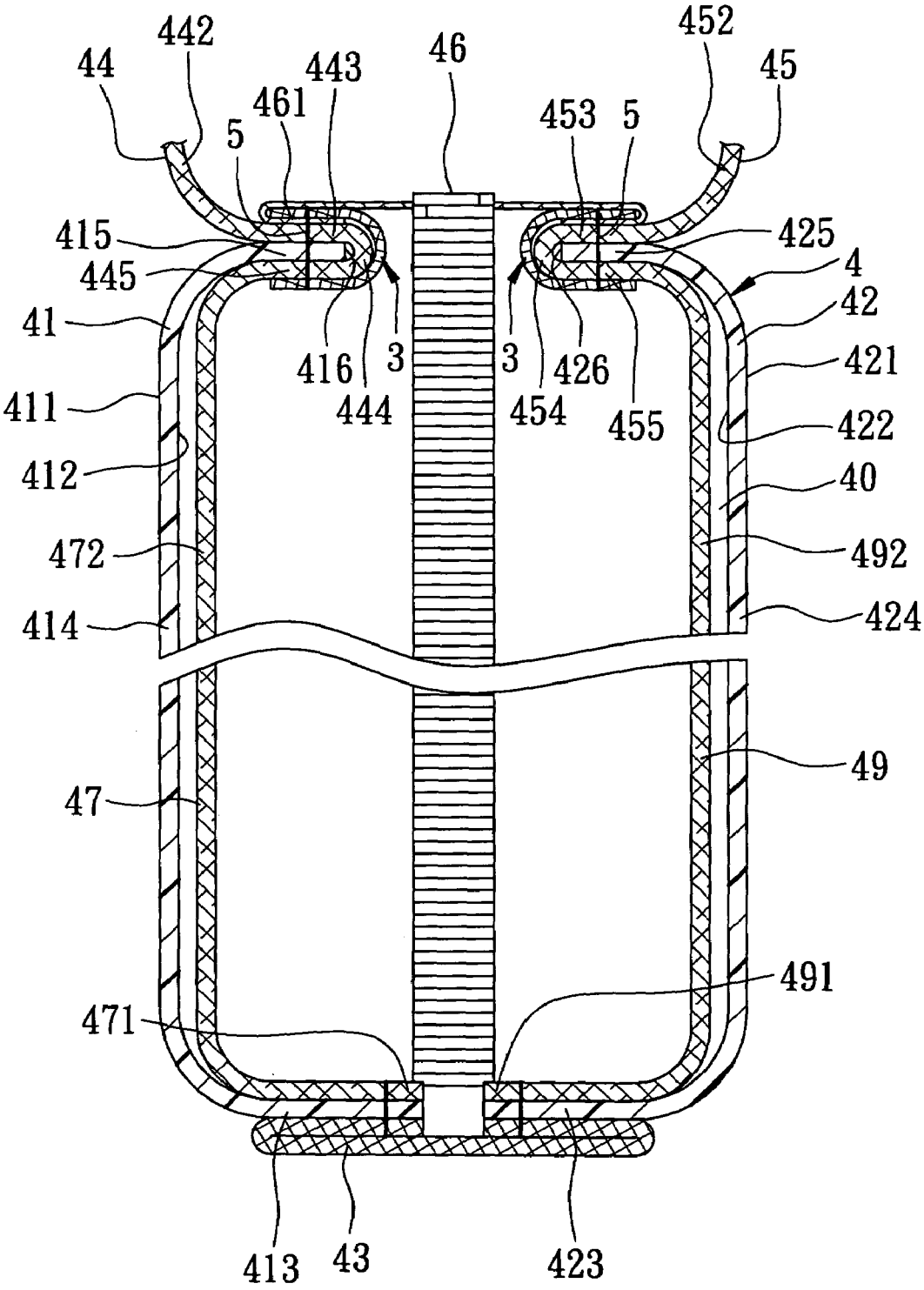
FIG. 5 is a fragmentary sectional view of the preferred embodiment in FIG. 4 in a closed state.

Referring to FIGS. 4 and 5, the preferred embodiment of a bag 4 according to the present invention is shown to comprise a base wall 43, front and rear shells 41,42, front and rear handles 44,45, and front and rear tension force resisting members 47,49.

The base wall 43 is elongated in a longitudinal direction, and has front and rear sides opposite to each other in a transverse direction relative to the longitudinal direction. The front and rear shells 41,42 are spaced apart from each other in the transverse direction. Each of the front and rear shells 41,42 has an outer wall surface 411,421 and an inner wall surface 412,422 opposite to each other. Each of the front and rear shells 41,42 includes a lower wall portion 413,423 which extends in the transverse direction, a major wall portion 414,424 which extends from the lower wall portion 413,423 in an upright direction transverse to the longitudinal and transverse directions and which terminates at an upper end, and an upper wall portion 415,425 which extends from the upper end in the transverse direction towards the upper end of the other one of the front and rear shells 41,42 and which terminates at an upper edge 416,426. The outer wall surface 411,421 at the upper wall portion 415,425 is superimposed upon and is connected to a respective one of the front and rear sides of the base wall 43.

As such, the inner wall surfaces 412,422 of the front and rear shells 41,42 and the base wall 43 cooperatively define a compartment 40 for accommodating a portable computer 2. In this embodiment, a large pocket 48 is provided on the inner wall surface 422 of the rear shell 42 for receiving the portable computer 2. A plurality of small pockets 48' are disposed on the inner wall surface 412 of the front shell 41 for receiving documents and accessories. The bag 4 further includes a zipper unit 46 disposed at peripheral edges of the front and rear shells 41,42 to close the compartment 40 so as to place the bag 4 in a closed state.

The front and rear handles 44,45 are made from a material more flexible than that of the front and rear shells 41,42. Each of the front and rear handles 44,45 includes a gripping segment 442,452, first and second upper superimposing segments 443,453, and first and second bent segments 444,454. The gripping segment 442,452 has first and second ends opposite to each other in the longitudinal direction. The first and second upper superimposing segments 443,453 extend respectively from the first and second ends of the gripping segment 442,452 to terminate at first and second junctures, respectively, and are superimposed upon the upper wall portion 415,425 of a corresponding one of the front and rear shells 41,42. The first and second bent segments 444,454 respectively extend from the first and second junctures to be bent over the upper edge 416,426 of the corresponding one of the front and rear shells 41,42 such that the first and second bent segments 444,454 are disposed underneath the inner wall surface 412,422 of the upper wall portion 415,425 of the corresponding one of the front and rear shells 41,42, and terminate at first and second underlying regions 445,455, respectively.

Front joining members 5, such as stitch lines, are disposed to respectively extend through the respective one of the first and second upper superimposing segments 443 of the front handle 44, the upper wall portion 415 of the front shell 41, and the respective one of the first and second underlying regions 445 of the front handle 44 so as to permit the upper wall portion 415 to be firmly sandwiched between the first upper superimposing segment 443 and the first underlying region 445, and between the second upper superimposing segment 443 and the second underlying region 445. Similarly, rear joining members 5, such as stitch lines, are disposed to respectively extend through the respective one of the first and second upper superimposing segments 453 of the rear handle 45, the upper wall portion 425 of the rear shell 42, and the respective one of the first and second underlying regions 455 of the rear handle 45 so as to permit the upper wall portion 425 to be firmly sandwiched between the first upper superimposing segment 453 and the first underlying region 455, and between the second upper superimposing segment 453 and the second underlying region 455.

The front and rear tension force resisting members 47,49 are made from the same material as that of the front and rear handles 44,45. Preferably, the front and rear tension force resisting members 47,49 are formed integrally with the front and rear handles 44,45, respectively. Each of the front and rear tension force resisting members 47,49 includes first and second lower superimposing segments 471,491 and first and second interconnecting segments 472,492. The first and second lower superimposing segments 471,491 are superimposed upon the inner wall surface 412,422 of a respective one of the front and rear shells 41,42 at the lower wall portion 413,423 so as to be stitched thereto. The first and second interconnecting segments 472,492 are disposed to extend in the upright direction along the inner wall surface 412,422 of the respective one of the front and rear shells 41,42 at the major wall portion 414,424 to interconnect the first lower superimposing segment 471,491 and the first underlying region 445,455 of a respective one of the front and rear handles 41,42, and the second lower superimposing segment 471,491 and the second underlying region 445,455 of the respective one of the front and rear handles 44,45, respectively.

In assembly, the first and second lower superimposing segments 471,491 of each of the front and rear tension force resisting members 47,49 are first stitched to the lower wall portion 413,423 and the base wall 43 so as to be firmly joined thereto. Then, each of the front and rear handles 44,45 are arranged in such a manner that the first and second underlying regions 445,455 and the first and second upper superimposing segments 443,453 are disposed on the inner and outer wall surfaces 412,422,411,421 of the respective one of the front and rear shells 41,42 at the upper wall portion 415,425 so as to form first and second assembles, each of which is then covered with a fabric 3. Thereafter, the assemblies are respectively connected to a zipper tape 461 of the zipper unit 46 by means of a respective one of the front and rear joining members 5.

As illustrated, by means of the bent segments 444,454 that are bent over the upper edges 416,426 of the front and rear shells 41,42, and by means of the underlying regions 445, 455 that are stitched to the upper wall portions 415,425 of the front and rear shells 41,42, the front and rear handles 44,45 can be firmly connected to the front and rear shells 41,42. Besides, with the lower superimposing segments 471,491 of the tension force resisting members 47,49 stitched to the lower wall portions 413,423 of the front and rear shells 41,42 and the base wall 43, the bag 4 is more durable and sturdy, and can be used to carry a relatively heavy load, thereby prolonging the service life of the bag 4.

Figure 6:
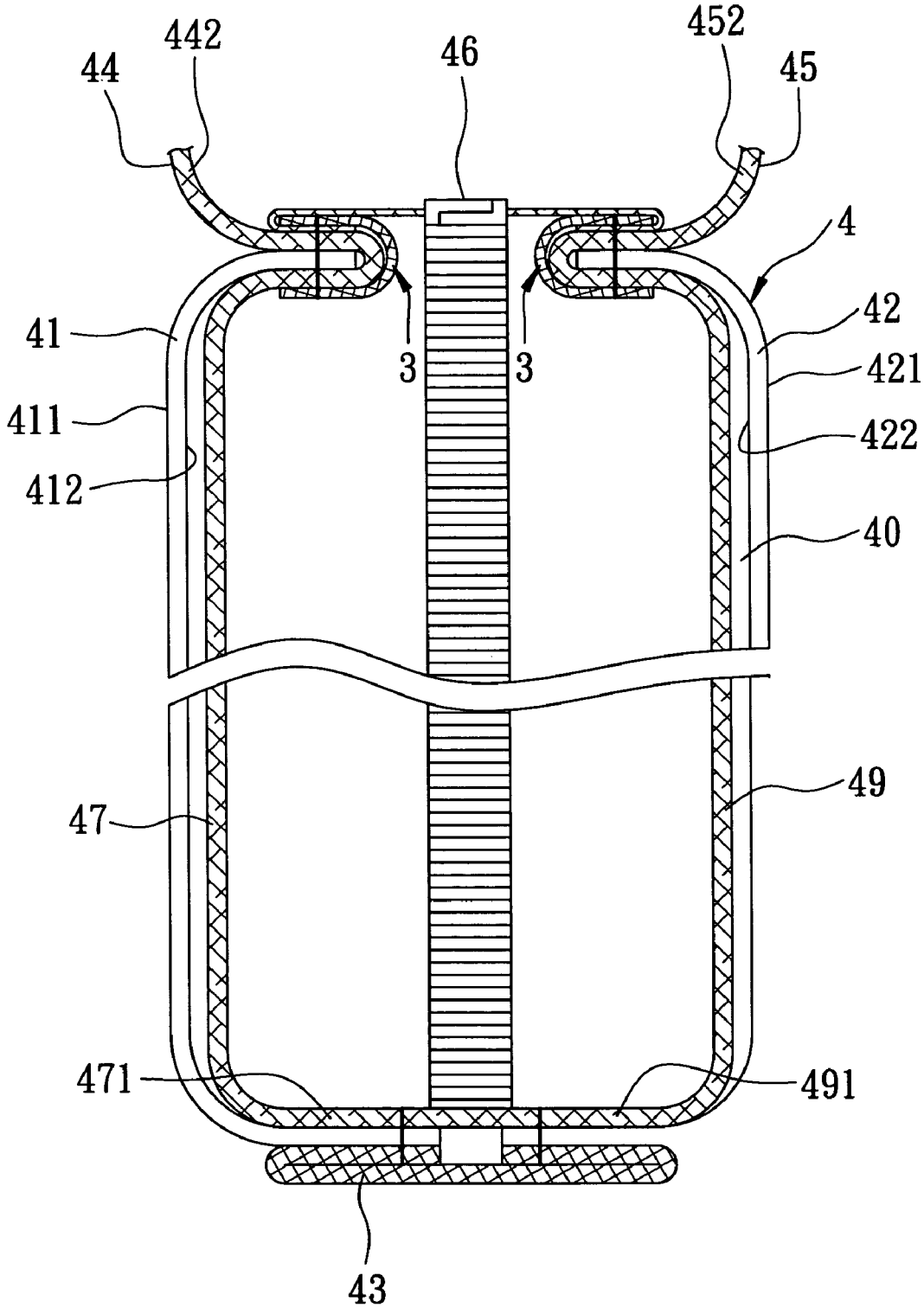
FIG. 6 is a fragmentary sectional view of a modified embodiment of a bag according to this invention.

FIG. 6 shows a modified embodiment of the bag 4 according to this invention. In this embodiment, the first lower superimposing segments 471,491 of the front and rear tension force resisting members 47,49 are interconnected and are formed integrally with each other. The second lower superimposing segments 471,491 of the front and rear tension force resisting members 47,49 are interconnected and are formed integrally with each other.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A bag comprising:

a base wall elongated in a longitudinal direction, and having front and rear sides opposite to each other in a transverse direction relative to the longitudinal direction;

front and rear shells spaced apart from each other in the transverse direction, each of said front and rear shells including a lower wall portion which extends in the transverse direction and which is connected to a respective one of said front and rear sides of said base wall, a major wall portion which extends from said lower wall portion in an upright direction transverse to the longitudinal and transverse directions and which terminates at an upper end, and an upper wall portion which extends from said upper end in the transverse direction towards said upper end of the other one of said front and rear shells and which terminates at an upper edge, each of said front and rear shells having an inner wall surface and an outer wall surface opposite to each other, said inner wall surfaces of said front and rear shells cooperatively defining a compartment for accommodating a portable computer;

front and rear handles made from a material more flexible than that of said front and rear shells, each of said front and rear handles including:

a gripping segment having first and second ends opposite to each other in the longitudinal direction, first and second upper superimposing segments which extend respectively from said first and second ends and which terminate at first and second junctures, respectively, said first and second upper superimposing segments being superimposed upon said upper wall portion of a corresponding one of said front and rear shells, and first and second bent segments which extend respectively from said first and second junctures to be bent over said upper edge of the corresponding one of said front and rear shells such that said first and second bent segments are disposed underneath said inner wall surface of said upper wall portion of the corresponding one of said front and rear shells, and terminate at first and second underlying regions, respectively, front joining members, each disposed to interconnect a respective one of said first and second upper superimposing segments of said front handle, said upper wall portion of said front shell, and a respective one of said first and second underlying regions of said front handle so as to permit said upper wall portion of said front shell to be firmly sandwiched between said first upper superimposing segment and said first underlying region of said front handle, and between said second upper superimposing segment and said second underlying region of said front handle; and rear joining members, each disposed to interconnect a respective one of said first and second upper superimposing segments of said rear handle, said upper wall portion of said rear shell, and a respective one of said first and second underlying regions of said rear handle so as to permit said upper wall portion of said rear shell to be firmly sandwiched between said first upper superimposing segment and said first underlying region of said rear handle, and between said second upper superimposing segment and said second underlying region of said rear handle.

2. The bag of claim 1, wherein each of said front joining members includes a stitch line which extends through the respective one of said first and second upper superimposing segments of said front handle, said upper wall portion of said front shell, and the respective one of said first and second underlying regions of said front handle, each of said rear joining members including a stitch line which extends through the respective one of said first and second upper superimposing segments of said rear handle, said upper wall portion of said rear shell, and the respective one of said first and second underlying regions of said rear handle.

3. The bag of claim 2, further comprising front and rear tension force resisting members which are made from the same material as that of said front and rear handles, each of said front and rear tension force resisting members including first and second lower superimposing segments which are superimposed upon and which are stitched to said lower wall portion of a respective one of said front and rear shells, and first and second interconnecting segments disposed to extend in the upright direction along said inner wall surface of the respective one of said front and rear shells at said major wall portion to interconnect said first lower superimposing segment and said first underlying region of a respective one of said front and rear handles, and said second lower superimposing segment and said second underlying region of the respective one of said front and rear handles, respectively.

4. The bag of claim 3, wherein said front and rear tension force resisting members are formed integrally with said front and rear handles, respectively.

5. The bag of claim 4, wherein said base wall is disposed underneath said outer wall surfaces of said front and rear shells at said lower wall portions, said first and second lower superimposing segments of each of said front and rear tension force resisting members being further stitched to said base wall so as to firmly join said first and second lower superimposing segments of each of said front and rear tension force resisting members, said lower wall portion and said base wall together.

6. The bag of claim 5, wherein said first lower superimposing segments of said front and rear tension force resisting members are interconnected and are formed integrally with each other, said second lower superimposing segments of said front and rear tension force resisting members being interconnected and being formed integrally with each other.

* * * * *